US012011070B2

(12) United States Patent
Timpson et al.

(10) Patent No.: US 12,011,070 B2
(45) Date of Patent: Jun. 18, 2024

(54) WALLET APPARATUS WITH DYE-SUBLIMATION PRINTED GRAPHICS

(71) Applicant: CAPPLA, LLC, Kanarraville, UT (US)

(72) Inventors: Carl Timpson, Cedar City, UT (US); Jaden Seely, Hurricane, UT (US); Mitch Seely, St. George, UT (US); Jacob Amezcua, Lehi, UT (US)

(73) Assignee: CAPPLA, LLC, Kanarraville, UT (US)

( * ) Notice: Subject to any disclaimer, the term of this patent is extended or adjusted under 35 U.S.C. 154(b) by 24 days.

(21) Appl. No.: 17/589,984

(22) Filed: Feb. 1, 2022

(65) Prior Publication Data

US 2022/0240635 A1 Aug. 4, 2022

Related U.S. Application Data

(60) Provisional application No. 63/144,040, filed on Feb. 1, 2021.

(51) Int. Cl.
*A45C 1/06* (2006.01)

(52) U.S. Cl.
CPC ..... *A45C 1/06* (2013.01)

(58) Field of Classification Search
CPC ..... A45C 1/06
See application file for complete search history.

(56) References Cited

U.S. PATENT DOCUMENTS

| | | | | |
|---|---|---|---|---|
| 1,670,343 | A * | 5/1928 | Clemens | A45C 11/18 206/39 |
| 3,280,735 | A * | 10/1966 | Clark | B41M 5/38235 250/318 |
| 4,990,485 | A * | 2/1991 | Egashira | B41M 5/529 503/227 |
| 6,348,260 | B1 * | 2/2002 | Ogawa | B41M 5/395 428/206 |
| D896,506 | S * | 9/2020 | Anderson | D3/232 |
| 2004/0143914 | A1 * | 7/2004 | Flaherty | B32B 7/06 8/512 |
| 2013/0276943 | A1 * | 10/2013 | Minn | A45C 1/06 150/137 |
| 2015/0083289 | A1 * | 3/2015 | Johnson | A45C 1/06 150/144 |
| 2016/0324283 | A1 * | 11/2016 | Kane | A45C 11/182 |
| 2017/0055654 | A1 * | 3/2017 | King | A45C 11/182 |

OTHER PUBLICATIONS

Ridge Wallet: (https://www.youtube.com/watch?v=q2d4OfrlvpQ) (Year: 2018).*
Weiye: (https://www.amazon.co.uk/Sublimation-Blank-Wallet-Transfer-blanks/dp/B08C28NF6T?th=1) (Year: 2020).*
(Continued)

*Primary Examiner* — Don M Anderson
*Assistant Examiner* — Justin Caudill
(74) *Attorney, Agent, or Firm* — Gurr Brande & Spendlove, PLLC; Robert A. Gurr

(57) ABSTRACT

A wallet apparatus has a first side plate and a second side plate, preferably made from metal. Further, the first side plate and second side plate may both receive a printed graphic, such as a family portrait, painting, or geometric lines, through a dye-sublimation printing process, which allows the transfer of high-resolution graphics onto the wallet.

2 Claims, 5 Drawing Sheets

(56) References Cited

OTHER PUBLICATIONS

Hawkinsdyesub: (https://www.etsy.com/listing/241889646/) (Year: 2020).*
Best Blanks: (https://www.youtube.com/watch?v=4h35FX7RaXQ) (Year: 2011).*
Scdom: (https://www.amazon.com/Universal-Sublimation-Coating-Scdom-Pretreatment/dp/B09P83LP7B/) (Year: 2021).*
Dango Products: (https://www.youtube.com/watch?v=Sj60qwXjZAA) (Year: 2018).*
Prolab Digital: (https://www.youtube.com/watch?v=S6TjpJblJvY) (Year: 2014).*
Rodriguez: How to sublimate an image to aluminum. (https://www.youtube.com/watch?v=Pk_8gbagDiE) (Year: 2018).*
DMC Productions: Sublimation on Aluminum. (https://www.youtube.com/watch?v=oxdgaSsU2Bw) (Year: 2021).*
Signi Aluminum: printable aluminum sheets & blank for Dye Sublimation Printing 6061 1100 1200 t6 Brush Gold/Silver (https://www.youtube.com/watch?v=t_kjYaWsXYk) (Year: 2018).*

* cited by examiner

WALLET APPARATUS WITH DYE-SUBLIMATION PRINTED GRAPHICS

CROSS-REFERENCE TO RELATED APPLICATIONS

This application claims the benefit of U.S. Provisional Application Ser. No. 63/144,040, filed on Feb. 1, 2021, which is incorporated herein by reference.

TECHNICAL FIELD

The present disclosure relates to metal wallets. More particularly, the present disclosure relates to customizing metal wallets via dye-sublimation printing.

BACKGROUND

Wallets have been used to store paper currency for years. In fact, wallets can be found throughout history, with some of the earliest configurations being used in ancient Greece and during the Renaissance. These early wallets have evolved over the years to include different shapes, configurations, and materials. For example, some of the wallets that may be found in modern times consist of bi-fold wallets and tri-fold wallets (leather or canvas material), money clip wallets, RFID signal blocking wallets, and metal wallets.

Contemporary metal wallets often comprise material that block thieves from accessing and stealing information from credit cards. These metal wallets are also configured to have a slim profile so as to be easily carried in any pocket, especially a front pocket. Additionally, many metal wallets on the market are customizable in configuration as well as fashion, which often arises in the color of the metal or material being used. Individuals have options to customize the look of the metal wallet, such as by using a certain metal (copper, bronze, steel, etc.). However, with the many metals being used, customization of the metals, such as color, is limited to a few techniques, which may be time-consuming and increase the price of the metal wallet. Some of these coloring techniques include a base paint and colored pencils, alcohol inks, acrylic paint, heat coloration, and powder coating. These types of coloring techniques can create difficulties and be labor intensive for a manufacturer when it comes to truly customizing a metal wallet for a consumer. Furthermore, these types of coloring techniques may not create the detailed image that is desired.

Dye sublimation is a process that allows for images to be transferred to metal. As a result, dye sublimation has been used to transfer high quality images onto metal, such as aluminum, for display. 3000 series aluminum is fairly standard in the industry for such printing. However, 3000 series aluminum does not work for a wallet, as it is too weak and soft. As a result, there is a need for a dye sublimation process that is capable of being utilized with a stronger series of aluminum, such as 6000 series.

Accordingly, there is a need for a metal customization process that is quick, easy, and allows for highly customizable and detailed printed graphics on metal wallets such as on 6000 series aluminum and similar. The present disclosure seeks to solve these and other problems.

SUMMARY OF EXAMPLE EMBODIMENTS

In some embodiments, a wallet apparatus comprises a first side plate and a second side plate, and a strap surrounding the first and second side plates to secure money. The first side plate and second side plate may be made from aluminum. In some embodiments, the first side plate and second side plate comprise finger slots, which allow a user to easily insert and/or remove credit cards, driver's license, or any other type of card or currency. Further, the first side plate and second side plate may both receive a printed graphic (e.g., family portrait, painting, geometric lines, etc.). The aluminum sides plates are coupled using elastics.

In some embodiments, a method of customizing metal wallets comprises using dye-sublimation printing to customize a first side plate and a second side plate. A printed graphic is printed onto a transfer paper using dye-sublimation ink. The printed graphic may include any photo, color, design, etc. which may be placed on the metal wallet. To transfer the image from the transfer paper to the wallet, the transfer paper is placed on the metal and heat and pressure is introduced to the paper via, for example, a heat press. When the transfer paper is heated, the image, with the dye, turns from a solid into a gas and permeates the metal, thereby transferring and binding the image from the paper onto the metal wallet.

DETAILED DESCRIPTION OF EXAMPLE EMBODIMENTS

Figure 1:
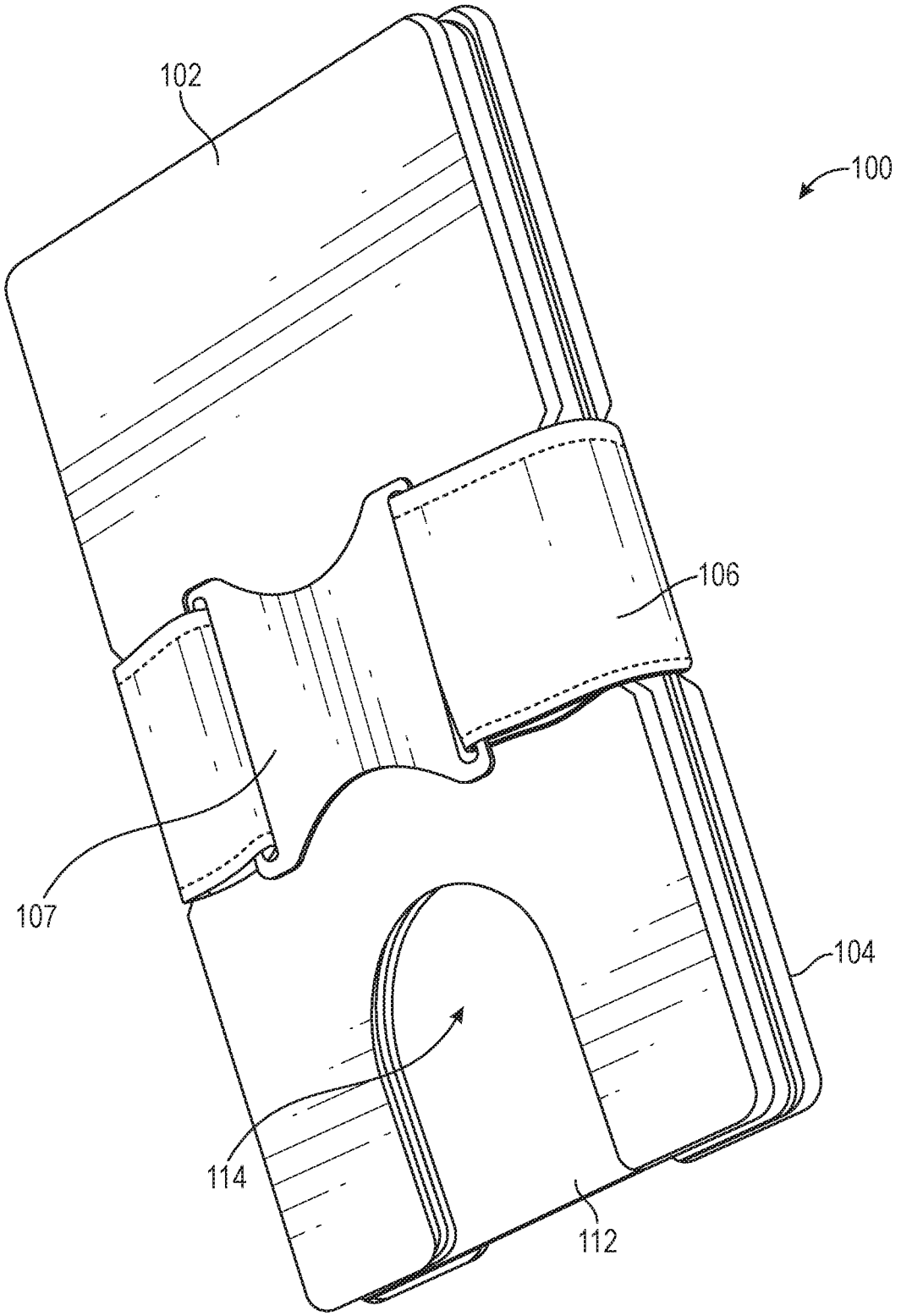
FIG. 1 is a front perspective view of a wallet apparatus.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As discussed earlier, there is a need for a metal customization process that is quick, easy, and allows for highly customizable and detailed printed graphics on metal wallets made from durable metals, such as 6000 series aluminum. The present disclosure seeks to solve these and other problems.

Metal wallets found in the prior art often include custom graphics and/or color. At times, changing the color of the metal wallets may be as simple as changing the metal material. For example, metals, such as copper, bronze, or steel, may be used to change the color and adhering properties of the metal wallet. Additionally, other techniques for applying graphics and colors may involve a base paint and colored pencils, alcohol inks, acrylic paint, and heat coloration. However, these approaches are often time-consuming, which increases costs for manufacturers and eventually the consumer. Furthermore, the previously mentioned coloring/customization techniques fail to transfer detailed photos (e.g., high resolution) or vibrant colors to metal.

In contrast, the wallet apparatus and method of customizing metal wallets described herein comprise printed graphics by using dye-sublimation printing to adhere any color, geometric shape, graphic, or photo to metal. It will be appreciated that dye-sublimation printing allows a user to truly customize a wallet in accordance with their desires.

In some embodiments, as shown in FIG. 1, a wallet apparatus 100 comprises a first side plate 102, a second side plate 104, and a strap 106 surrounding the first and second side plates 102, 104 to secure money, or other items between the first and second side plates 102, 104. The first and second side plates 102, 104 may be made from aluminum, such as 6061 or 6063 series aluminum. However, it will be appreciated that other types of metal may be used, and in some embodiments, other materials capable of dye sublimation may be used, such as plastic, carbon fiber, or others. Series 6061 and 6063 aluminum is beneficial due to its weight, strength, corrosion resistance, and cost.

Figure 2:
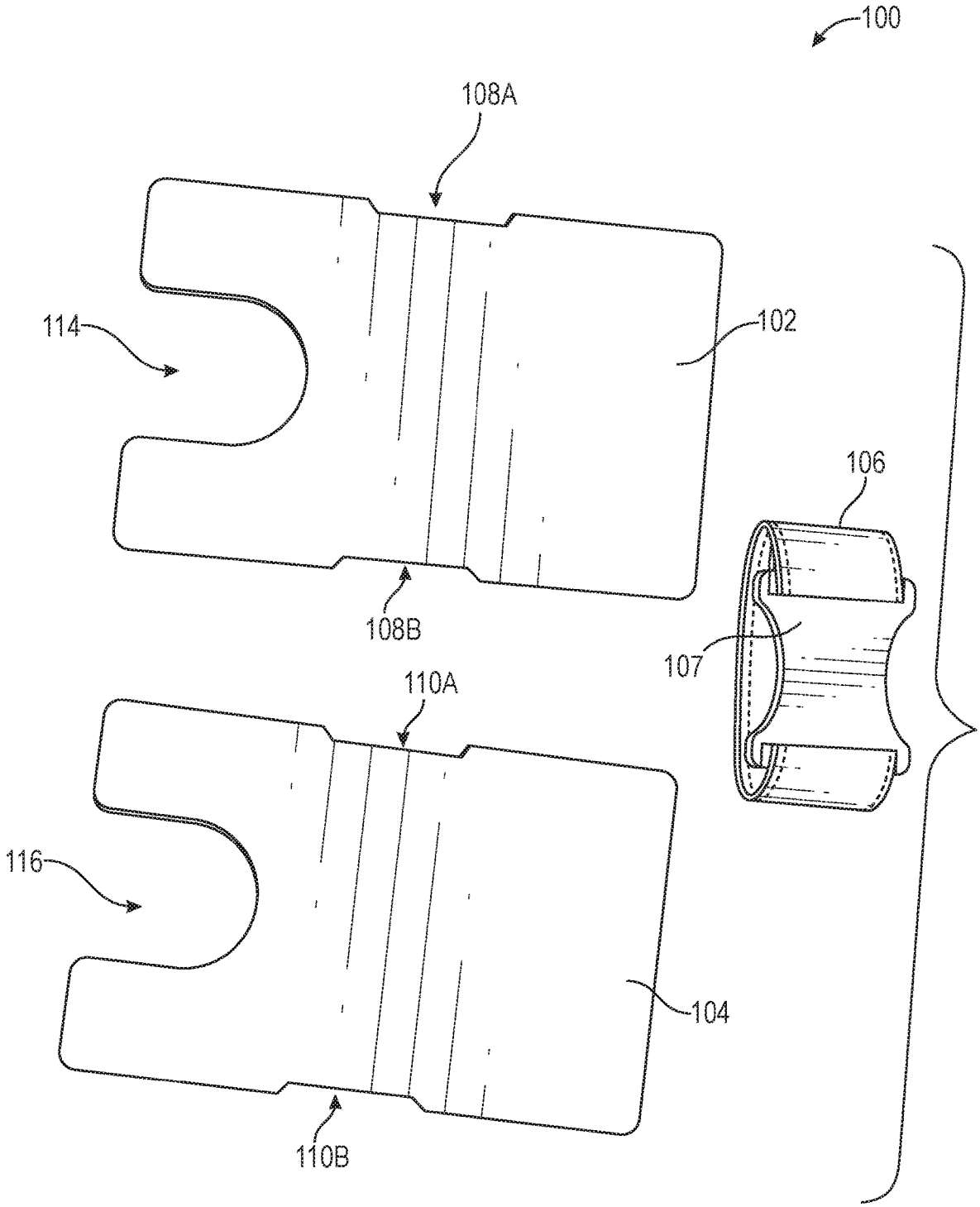
FIG. 2 is a front perspective view of a wallet apparatus disassembled.
Figure 3:
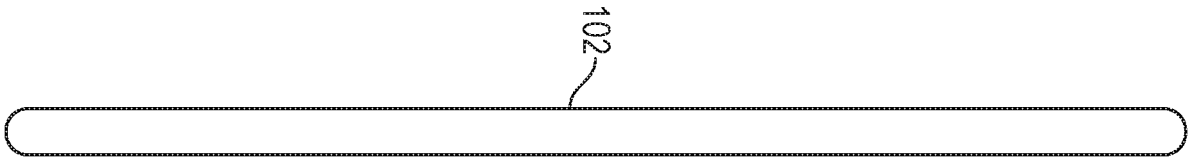
FIG. 3 is a bottom plan view of a side plate of a wallet apparatus.

The strap 106 is ideally elastic, allowing the distance between the first and second plates 102, 104 to vary, depending upon the contents interposed therein. The strap 106 may be continuous material, or may also include a buckle 107. As shown in FIG. 2, the first side plate 102 comprises a first strap notch 108A and a second strap notch 108B, and the second side plate 104 comprises a first strap notch 110A and second strap notch 110B. When the two plates 102, 104 are placed on one another, the first notches 108A and 110A and second notches 108B and 110B align respectively. Once aligned, the elastic strap 106 may be stretched around the plates 102, 104 so as to seat in the notches 108A-B and 110A-B. The elastic strap 106 ensures that the plates 102, 104 remain tight to one another (e.g., squeezes the plates together), securing contents, such as cards 112 (FIG. 1), therebetween. Due to the elasticity of the strap 106, cards 112 may be inserted between the side plates 102, 104, so as to remain interposed therebetween. Additionally, because of the notches 108A-B, 110A-B, the strap 106 directly contacts the cards 112, ensuring they remain secured. The notches also keep the strap 106 from sliding longitudinally along the side plates 102, 104.

Figure 4:
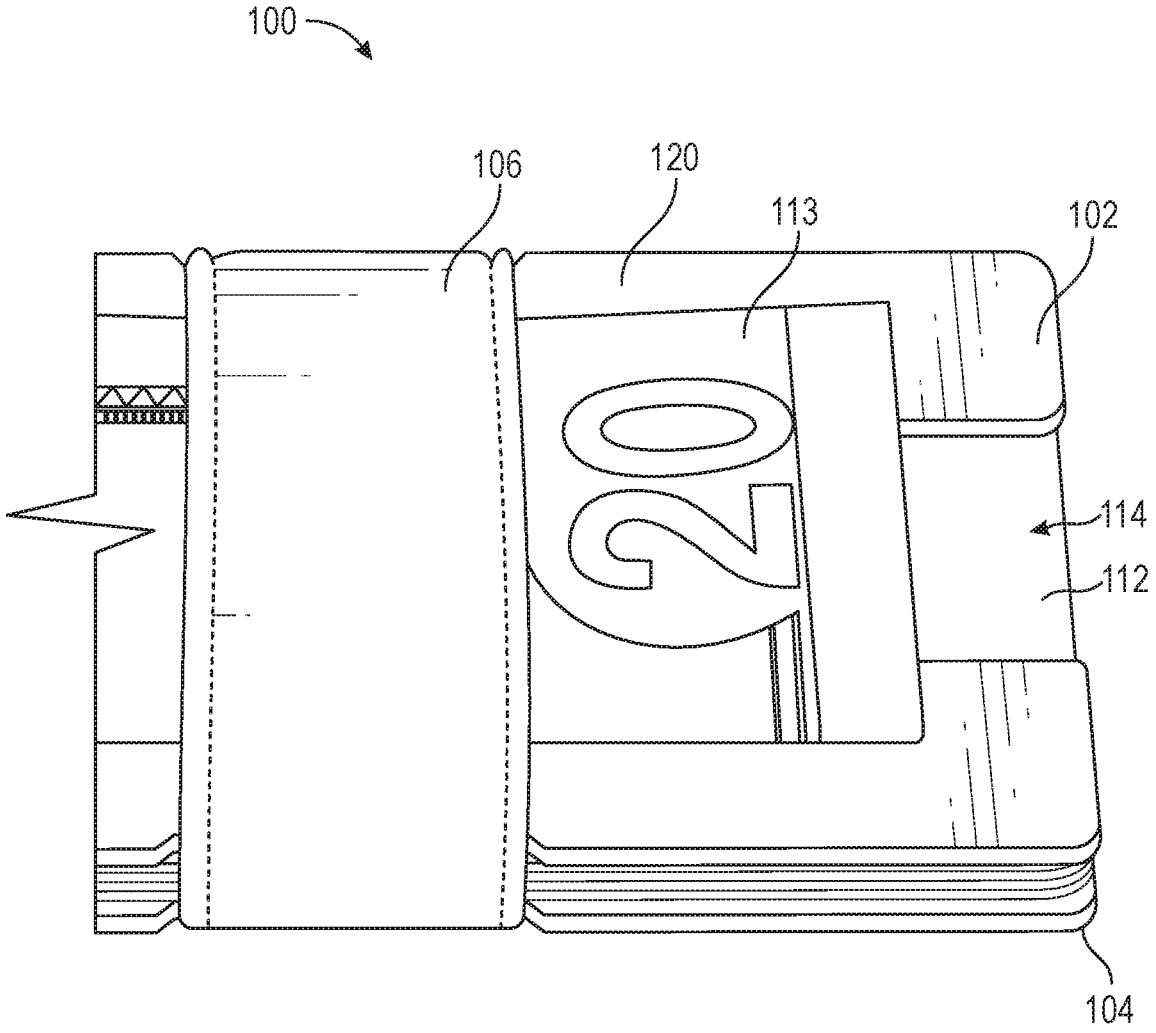
FIG. 4 is a front, side perspective detailed view of a wallet apparatus.

In some embodiments, the strap 106 may be coupled to the wallet apparatus 100 via tension, adhesive, hook and loop, etc. The strap 106 may be a stretchable material having elastic properties. Alternatively, the strap may be a non-stretchable material. An adjustable buckle may be coupled to the strap 106 so as to increase or decrease the length of the strap 106 around the wallet apparatus 100. It will be appreciated that, in some embodiments, the length of the strap 106 may be adjusted to carry various amounts of cash or cards. In some embodiments, as shown in FIG. 4, currency 113 may be inserted between the strap 106 and an exterior surface 120 of the first side plate 102. As a result, the currency 113 is held pressed against the first side plate 102.

In some embodiments, the first side plate 102 comprises a finger slot 114 and the second side plate 104 comprises a finger slot 116, which allow a user to easily insert and/or remove credit cards, a driver's license, any other type of card 112, or currency from the wallet apparatus 100.

It will be appreciated that the first side plate 102 and second side plate 104 may be identical, allowing for ease of manufacture and assembly. In other words, the same plate 102 may be manufactured twice, the second production being the second plate 104.

Figure 5:
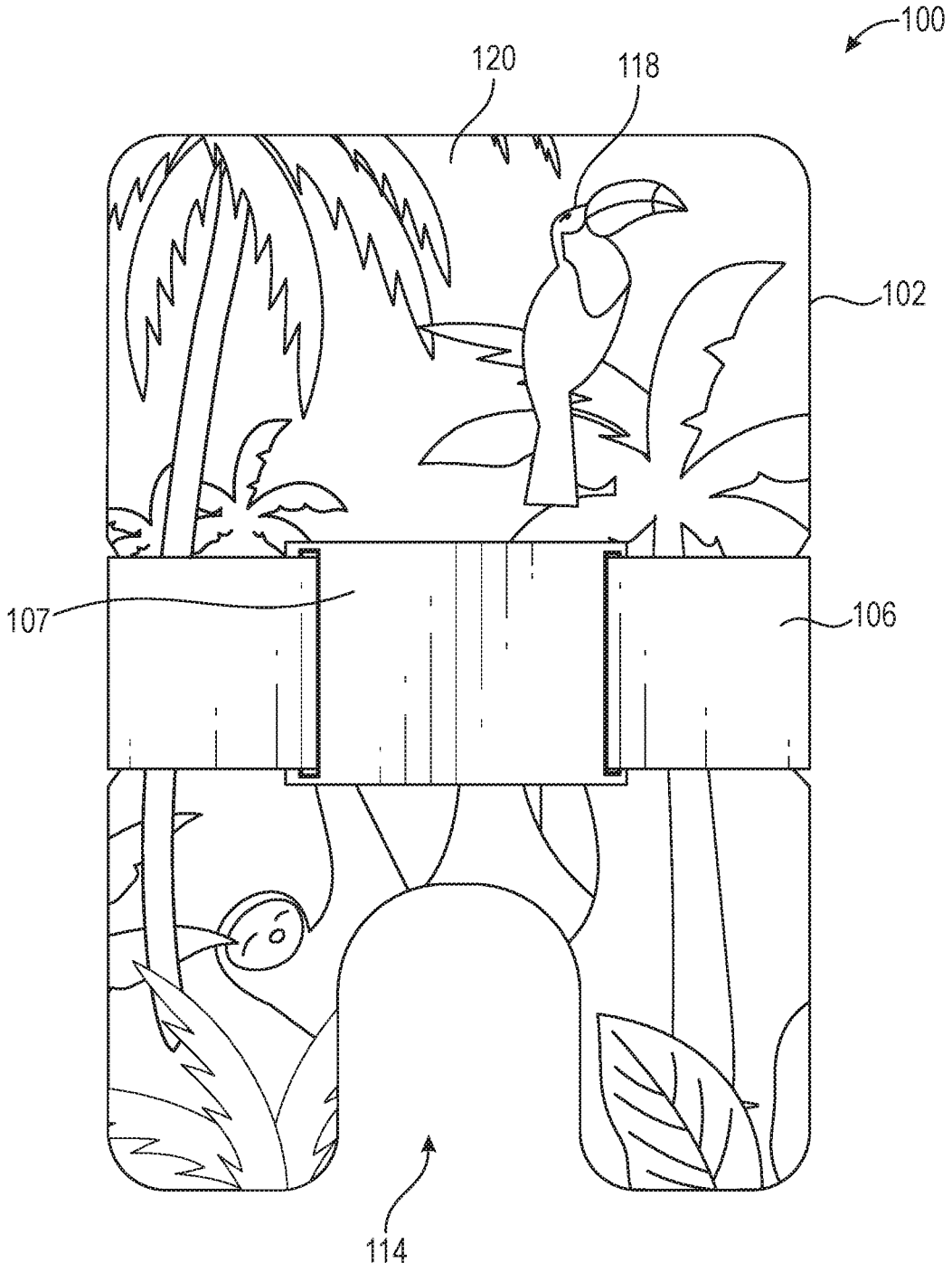
FIG. 5 is a front elevation view of a wallet apparatus with dye-sublimation graphics thereon.

Further, as shown in FIG. 5, at least the first side plate 102 may receive a printed graphic 118. The side plates 102, 104 may have jungle, floral, or any other type of graphic, including photos thereon. For example, the printed graphic 118 may be applied to a first exterior surface 120 on the first side plate 102. To apply the graphics 118, dye-sublimation printing may be utilized. It will be appreciated that dye-sublimation printing on the wallet apparatus 100 allows for detailed graphics to be transferred to the metal of the first side plate 102 and second side plate 104.

However, dye-sublimation in the art, suitable for 3000 series aluminum, is not sufficient for 6000 series aluminum, such as 6061 and 6063, due to the stronger alloys in the 6000 series aluminum. Accordingly, in one embodiment, a method of dye-sublimating on 6000 series aluminum comprises 1) applying a white paint coating to 6000 series aluminum sheets, 2) applying a clear chemical coating that bonds to the aluminum, 3) cutting and machining the coated aluminum into individual side plates 102, 104, and 4) applying the dye-sublimation print to the coated aluminum. To apply the dye-sublimation, a printed graphic 118 is printed onto a transfer paper using dye-sublimation ink. The printed graphic 118 may include any photo, color, design, etc. which may be placed on the metal wallet apparatus 100. To transfer the printed graphic 118 from the transfer paper to the wallet apparatus 100, the transfer paper is placed on a side plate 102, 104, as desired, and heat and pressure are introduced to the paper via, for example, a heat press. When the transfer paper is heated, the printed graphic 118, with the dye, turns from a solid into a gas and permeates the metal of the side plate 102, 104, thereby transferring and binding the image onto the metal wallet 100. Due to the stronger alloys used in the 6000 series, the standard heat and pressure in the art fails. Accordingly, 6000 series aluminum must be pretreated with the paint and clear chemical coating discussed above. Further, the heat press is generally hotter and presses longer to ensure the graphics transfer.

It will be appreciated that any image, color, etc. may be used in this method. Accordingly, a user may truly customize the look of their metal wallet. Unlike the prior art, using this method allows high-definition prints to be placed on the metal wallet apparatus 100 for both customization and fashion. This method allows for a higher definition image in very detailed colors and geometrics for personalization, which is not achievable by the prior art.

Accordingly, by using 6000 series aluminum, the wallet apparatus 100 maintains its integrity during use as a wallet, and is not subject to bending under normal use, unlike 3000 series aluminum. Further, by utilizing the steps outlined herein for dye-sublimation, high-resolution graphics are able to be transferred to the 6000 aluminum, which has not been achieved by the prior art.

It will also be appreciated that systems and methods according to certain embodiments of the present disclosure may include, incorporate, or otherwise comprise properties or features (e.g., components, members, elements, parts, and/or portions) described in other embodiments. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment unless so stated. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A wallet apparatus, comprising:

a first side plate manufactured from 6000 series aluminum and comprising a first white paint coating, a clear chemical coating, and a dye-sublimation printed graphic, the first side plate further comprising a first strap notch, a second strap notch, and a finger slot;

a second side plate manufactured from 6000 series aluminum and comprising a first white paint coating, a clear chemical coating, and a dye-sublimation printed graphic, the second side plate further comprising a first strap notch, a second strap notch, and a finger slot; and an elastic strap configured to squeeze the first side plate to the second side plate with the finger slot of the first side plate aligned with the finger slot of the second side plate, the elastic strap being received in the first strap notch and second strap notch of the first side plate and further received in the first strap notch and second strap notch of the second side plate.

2. A method of manufacturing a metal wallet apparatus, the method comprising:

applying a white paint coating to a 6000 series aluminum sheet;

applying a clear chemical coating on top of the white paint coating of the 6000 series aluminum sheet;

cutting and machining the 6000 series aluminum sheet into a plurality of individual side plates, each individual side plate comprising a first strap notch, a second strap notch, and a finger slot;

printing a graphic onto a transfer paper using dye-sublimation ink;

placing the transfer paper with the graphic on the clear chemical coating of at least one individual side plate of the plurality of side plates, the clear chemical coating interposed between the white paint coating and the transfer paper with the graphic; and using a heat press to transfer the graphic from the transfer paper to the at least one individual side plate; and securing a first individual side plate to a second individual side plate via an elastic strap configured to squeeze the first side plate to the second side plate with the finger slot of the first side plate aligned with the finger slot of the second side plate, the elastic strap being received in the first strap notch and second strap notch of the first side plate and further received in the first strap notch and second strap notch of the second side plate.

* * * * *